US007355571B2

(12) United States Patent
Yamada et al.

(10) Patent No.: US 7,355,571 B2
(45) Date of Patent: Apr. 8, 2008

(54) DISPLAY DEVICE AND ITS DRIVING METHOD

(75) Inventors: Hiroyasu Yamada, Hachioji (JP); Manabu Takei, Sagamihara (JP)

(73) Assignee: Casio Computer Co., Ltd., Tokyo (JP)

( * ) Notice: Subject to any disclaimer, the term of this patent is extended or adjusted under 35 U.S.C. 154(b) by 304 days.

(21) Appl. No.: 10/515,246

(22) PCT Filed: Jun. 9, 2003

(86) PCT No.: PCT/JP03/07295

§ 371 (c)(1),
(2), (4) Date: Nov. 19, 2004

(87) PCT Pub. No.: WO03/105117

PCT Pub. Date: Dec. 18, 2003

(65) Prior Publication Data

US 2005/0225518 A1 Oct. 13, 2005

(30) Foreign Application Priority Data

Jun. 7, 2002 (JP) ..... 2002-167390

(51) Int. Cl.
*G09G 3/30* (2006.01)

(52) U.S. Cl. ..... 345/76; 345/82

(58) Field of Classification Search ..... 345/76–83, 345/204

See application file for complete search history.

(56) References Cited

U.S. PATENT DOCUMENTS 4,042,854 A 8/1977 Luo et al.
4,996,523 A 2/1991 Bell et al.
5,302,966 A * 4/1994 Stewart ..... 345/76
5,446,344 A * 8/1995 Kanazawa ..... 315/169.4
5,990,629 A * 11/1999 Yamada et al. ..... 315/169.3
6,028,573 A * 2/2000 Orita et al. ..... 345/66
6,118,220 A * 9/2000 Shino et al. ..... 315/169.4
RE37,083 E * 3/2001 Kanazawa ..... 315/169.4
6,373,454 B1 4/2002 Knapp et al.
6,636,191 B2 * 10/2003 Cok ..... 345/82

(Continued)

FOREIGN PATENT DOCUMENTS

DE 42 31 436 A1 3/1994

(Continued)

*Primary Examiner*—Chanh D. Nguyen
*Assistant Examiner*—Robert E Carter
(74) *Attorney, Agent, or Firm*—Frishauf, Holtz, Goodman & Chick, P.C.

(57) ABSTRACT

A display panel (110) includes a plurality of optical elements (OEL) each having a pair of electrodes and performing an optical operation according to current passing between the pair of electrodes, a current line (DL), a switch circuit (Tr2) that passes a write current (Ia) with a predetermined current value through the current line (DL) during a selection time (Tse) and stops passing current during a nonselection time (Tnse), and a current storage circuit (Tr1, Tr3, Cs, Cp) that stores current data according to the current value of the write current (Ia) passing through the current line (DL) during the selection time (Tse) and that supplies a drive current (Ib) having a current value, which is obtained by subtracting a predetermined offset current (Ioff) from the current value of the stored write current (Ia), to the optical elements (OEL) during the nonselection time (Tnse).

26 Claims, 11 Drawing Sheets

U.S. PATENT DOCUMENTS

| | | | | |
|---|---|---|---|---|
| 6,661,397 | B2 * | 12/2003 | Mikami et al. | 345/76 |
| 6,734,636 | B2 * | 5/2004 | Sanford et al. | 315/169.3 |
| 6,989,805 | B2 * | 1/2006 | Inukai | 345/76 |
| 2002/0195968 | A1 | 12/2002 | Sanford et al. | |
| 2002/0196213 | A1 | 12/2002 | Akimoto et al. | |

FOREIGN PATENT DOCUMENTS

| | | | |
|---|---|---|---|
| EP | 0 365 445 | A2 | 4/1990 |
| JP | 2002-514320 | A | 5/2002 |
| JP | 2003-66905 | A | 3/2003 |
| JP | 2003-140612 | A | 5/2003 |
| JP | 2003-195809 | A | 7/2003 |
| WO | WO 99/38148 | A1 | 7/1999 |
| WO | WO 01/06484 | A1 | 1/2001 |

* cited by examiner

DISPLAY DEVICE AND ITS DRIVING METHOD

This application is a U.S. National Phase Application under 35 USC 371 of International Application PCT/JP03/07295 filed Jun. 9, 2003.

TECHNICAL FIELD

The present invention relates to a display device and a driving method for the display device and particularly to a display device having a display panel with arrangements of a plurality of optical elements that emit light with a predetermined luminance gray-scale by supplying current in accordance with an image signal, and a driving method for the display device.

BACKGROUND ART

Conventionally, there has been known a light-emitting type display device having a display panel in which organic electroluminescence devices (hereinafter referred to as "organic EL devices"), inorganic electroluminescence elements (hereinafter referred to as "inorganic EL devices") or self-luminous light emitting devices (optical elements) such as light-emitting diodes (LEDs) and the like are arranged in a matrix form.

Particularly, the light-emitting type display device using an active matrix drive system has higher display response speed than the liquid crystal display device that has recently sprung into wide use, no dependence on an angle of field, and is capable of providing high luminance and contrast, high definition of quality of display image, a reduction of power consumption, and the like. The light-emitting type display device has an extremely advantageous characteristic in which no backlight is required unlike the liquid crystal display device to allow the device to be much thinner and lighter.

Here, in the aforementioned display device having various kinds of light-emitting devices, drive control mechanisms for providing controlling light-emission control to light-emitting devices and control methods have been variously proposed. For example, there has been known a drive circuit (hereinafter referred to "pixel drive circuit" for the sake of convenience) having a plurality of switching devices such as thin-film transistors for providing the light-emission control to light-emitting devices for each of display pixels that forms the display panel in addition to the aforementioned light-emitting devices.

The following will explain a circuit diagram that is applied to display pixels of the display device having organic EL devices, which use organic compounds that have recently studied and developed actively toward practical use as light-emitting materials, among the aforementioned various kinds of light-emitting devices, with reference to the drawings.

FIGS. 11A and 11B are circuit diagrams each illustrating an example of the structure of the display pixel of the prior art in the light-emitting device type display device having organic EL devices.

For example, as shown in FIG. 11A, in the vicinity of each intersection point of plural scan lines SL and a data line DL that are arrayed in a matrix form on the display panel, the display pixel of the prior art is structured to have a pixel drive circuit DP1, which includes a thin-film transistor Tr 11 where a gate terminal is connected to the scan line SL, a source terminal and a drain terminal are connected to the data line DL and a node 11, respectively, and a thin-film transistor Tr 12 where a gate terminal is connected to the node N11 and a source terminal is connected to a power line VL, respectively, and an organic EL device (light emitting device) OEL where an anode terminal is connected to the drain terminal of the thin-film transistor Tr12 of the pixel drive circuit DP1 and a cathode terminal is connected to a ground potential. In this case, in FIG. 11A, C11 denotes a parasitic capacitance that is formed between the gate and source of the thin-film transistor Tr12.

In other words, the pixel drive circuit DP1 illustrated in FIG. 11A is structured such that two transistors of thin-film transistors Tr11 and Tr12 are ON-OFF controlled to provide light-emission control to the organic EL device OEL as shown in below.

In the pixel drive circuit DP1 having such a structure, when a high-level scan signal is applied to the scan line SL to set the display pixel to a selection state by a scan driver (omitted in the figure), the thin-film transistors Tr11 is turned on, thereby a signal voltage (gray-scale voltage) applied to the data line DL by a data driver (omitted in the figure) is applied to the gate terminal of the thin-film transistor Tr12 via the thin-film transistor Tr11 in accordance with display data (image signal). As a result, the thin-film transistor Tr12 turns on in an electrically continuous state according to the above signal voltage, so that a predetermined drive current flows from the power line VL via the thin-film transistor Tr12 and the organic EL device OEL emits with a luminance gray-scale according to display data.

Next, when a low level scan signal is applied to the scan line SL to set the display pixel to a non-selection state, the thin-film transistor Tr11 is turned off, thereby the data line DL and the pixel drive circuit DP1 is electrically disconnected. As a result, the voltage applied to the gate terminal of the thin-film transistor Tr12 is held by the parasitic capacitance C11 and the thin-film transistor Tr12 is maintained in an ON state, so that a predetermined drive current flows into the organic EL device OEL and the light-emitting operation is continued. This light-emitting operation is controlled to be continued for, e.g., one frame period until the signal current is written to the each display pixel according to next display data.

Such the driving method is called as a voltage drive system for the reason that the drive current to flow to the light-emitting device is controlled by adjusting the voltage to be applied to each display pixel to operate light-emission with a predetermined luminance gray-scale.

Moreover, for example, as shown in FIG. 11B, in the vicinity of each intersection point of first and second scan lines SL1 and SL2, which are arrayed in parallel to each other, and data lines D, the display pixel of the prior art as another example is structured to have a pixel drive circuit DP2, which includes a thin-film transistor Tr21 where a gate terminal is connected to the first scan line SL1, and a source terminal and a drain terminal are connected to the data line DL and a node N21, respectively, a thin-film transistor Tr22 where a gate terminal is connected to the second scan line SL2 and a source terminal and a drain terminal are connected to nodes N21 and N22, respectively, a thin-film transistor Tr23 where a gate terminal is connected to the node N22 and a source terminal is connected to the power line VL and a drain terminal is connected to the node N21, respectively, a thin-film transistor Tr24 where a gate terminal is connected to the node N22 and a source terminal is connected to the power line VL, respectively, and an organic EL device (light emitting device) OEL where an anode terminal is connected to the drain terminal of the thin-film transistor Tr24 of the pixel drive circuit DP2 and a cathode terminal is connected to a ground potential.

Here, in FIG. 11B, the thin-film transistor Tr21 is formed of a n-channel type MOS transistor (NMOS), and each of the thin-film transistors Tr22 to Tr24 is formed of a p-channel type MOS transistor (PMOS). C21 denotes a parasitic capacitance that is formed between the gate and source of each of the thin-film transistors Tr23 and Tr24 (between node N 22 and power line VL). In other words, the pixel drive circuit DP2 illustrated in FIG. 11B is structured such that four transistors of thin-film transistors Tr21 to Tr24 are ON-OFF controlled to provide light-emission control to the organic EL device OEL as shown in below.

In the pixel drive circuit having such a structure, when a low-level scan signal and a high-level scan signal are applied to the scan lines SL1 and SL2, respectively, to set the display pixel to a selection state by a scan driver (omitted in the figure), the thin-film transistors Tr21 and Tr22 are turned on, thereby a signal current (gray-scale current) supplied to the data line DL by a data driver (omitted in the figure) is fetched to the node N22 via the thin-film transistors Tr21 and Tr22 in accordance with display data, and the signal current level is converted to a voltage level by the thin-film transistor Tr23, so that a predetermined voltage occurs between the gate and source (writing operation).

After that, for example, when a low-level scan signal is applied to the scan line SL2, the thin-film transistor Tr22 is turned off, thereby the voltage occurred between the gate and source of the thin-film transistor Tr23 is held by the parasitic capacitance C21. Next, when a high-level scan signal is applied to the scan line SL1, the thin-film transistor Tr21 is turned off, thereby the data line DL and the pixel drive circuit DP2 are electrically disconnected. As a result, the thin-film transistor Tr24 is turned on, so that a predetermined drive current flows from the power line VL via the thin-film transistor Tr24 and the organic EL device OEL emits with a luminance gray-scale according to display data (light-emitting operation).

Here, a drive current to be supplied to the organic EL deice OEL via the thin-film transistor Tr24 is controlled to reach a current value that is based on the luminance gray-scale of display data, and this light-emitting operation is controlled to be continued for, e.g., one frame period until the signal current is written to the each display pixel according to next display data.

Such the driving method is called as a current designation system for the reason that the current where the current value is designated to each display pixel according to display data is supplied and the drive current to flow to the organic EL device is controlled based on the voltage held according to the current value to perform a light-emitting operation with a predetermined luminance gray-scale.

However, the display device with the aforementioned various kinds of pixel drive circuits in the display pixel has the following problems.

Namely, the pixel drive circuit using the voltage drive system as illustrated in FIG. 11A has the problem in that when device characteristics of two thin-film transistors Tr 11 and Tr12 such as a channel resistance, and the like are changed by ambient temperature, variation with the passage of time, and the like, this exerts an influence upon the drive current supplied to the light-emitting devices to make it difficult to realize a predetermined light-emitting characteristic stably for a long time.

Moreover, there is a problem in that when each of the display pixels that forms the display panel is made finer to improve high definition of the display image quality, a variation in the operation characteristic such as source-drain current of each of the thin-film transistors Tr11 and Tr12 that forms the pixel drive circuit increases, so that appropriate gray-scale control cannot be performed and a variation in the display characteristic of each display pixel occurs, causing deterioration in the image quality.

Further, in the pixel drive circuit illustrated in FIG. 11A, it is necessary to use the PMOS transistor as the thin-film transistor Tr12 such that the source terminal of thin-film transistor Tr12, which supplies the drive current to the light-emitting devices, is connected to the power supply line VL and the cathode terminal of the light-emitting device is connected to the ground potential in view of the circuit structure to continue the light-emitting operation in a non-selection state. In this case, when amorphous silicon is used, the PMOS transistor with the sufficient operation characteristic and function cannot be formed. For this reason, the manufacturing techniques for polysilicon and monocrystal silicon must be used in the case of the structure in which the PMOS transistor is mixed in the light-emitting drive circuit. However, the manufacturing techniques using polysilicon and monocrystal silicon are complicated in the manufacturing process and expensive in the manufacturing cost as compared with the manufacturing techniques using amorphous silicon. This causes a problem in an increase in the manufacturing cost of the display device having the light-emitting drive circuits.

Furthermore, in the pixel drive circuit using the current designation system as illustrated in FIG. 11B, the thin-film transistor Tr23, which converts the current level of the signal current supplied to each display pixel according to display data to the voltage level, and the thin-film transistor Tr24, which supplies the drive current with a predetermined current value, are provided, the influence caused by variations in the operation characteristic of each thin-film transistor can be suppressed to a certain extent by setting the signal current to be supplied to the light-emitting devices.

However, in the pixel drive circuit using the aforementioned current designation system, for writing the signal current, which is based on display data with relatively low luminance gray-scale, onto each display pixel, it is necessary to supply the signal current with a small value corresponding to the luminance gray-scale of display data. However, the operation for writing display data onto each display pixel is equivalent to the fact that the data line is charged up to a predetermined voltage. Particularly, when the wire length of the data line is designed to be longer because of the increase in the size of the display panel, there occurs a problem in that the smaller the current value of the signal current becomes, the more time required for a writing operation to the display pixel increases. As a result, when the number of scan lines is increased with high definition of the display panel and the selection time of the scan line is set to be short, the writing operation to the display pixel becomes insufficient at the low gray-scale time, making it difficult to obtain a good quality of the display image.

In contrast to this, for example, the pixel drive circuit as illustrated in FIG. 11B is structured such that the thin-film transistors Tr23 and Tr24 form a current mirror circuit structure and the current to be supplied to the display pixel becomes small with respect to the signal current to be supplied to the data line. As a result, even if the signal current with a relatively small current value is written to each display pixel at the low gray-scale time, the current value of the current to be supplied to the data line can be made relatively large, and time required for a writing operation to the display pixel is reduced to make it possible to improve the quality of display image.

However, in the pixel drive circuit having such the structure, the value of the current to be supplied to the data line is proportional to the drive current to be supplied to the light-emitting devices and becomes a value with predetermined ratio times of the drive current. For this reason, when the current ratio is set to such a value that the writing operation can be sufficiently performed even at the minimum gray-scale time, the value of the signal current to be supplied to the data line becomes an excessive value at an upper gray-scale time, causing a problem in that power consumption for the display device is increased.

DISCLOSURE OF INVENTION

The present invention has an effect in that in a display device that control optical elements by a current designation system, even if a small drive current is supplied to optical elements at the time of low gray-scale, time required for a writing operation can be shortened to improve display response speed and good display quality can be obtained on high definition display panel, and an effect in that an increase in current relating to a display data writing operation is controlled to make it possible to suppress an increase in power consumption of the display device.

In order to attain the above effects, the display device of the present invention comprises a display panel which includes a plurality of optical elements each having a pair of electrodes and performing an optical operation according to current passing between the pair of electrodes, a current line, a switch circuit that passes a write current with a predetermined current value through the current line during a selection time and stops passing current during a non-selection time, and a current storage circuit that stores current data according to the current value of the write current passing through the current line during the selection time and that supplies a drive current having a current value, which is obtained by subtracting a predetermined offset current from the current value of the stored write current, to the optical elements during the non-selection time.

Moreover, in order to attain the above effect, a display device driving method according to the present invention includes the current storing step of supplying a write current with a predetermined current value to a current storage circuit during a selection time to store current data to the current storage circuit according to the current value of the write current, and the display step of supplying a drive current with a current value, which is obtained by subtracting a predetermined offset current from the current value of write data stored in the current storing step, to optical elements during a non-selection time.

According to the present invention, in contrast to the drive current to be supplied to the optical elements during the non-selection time, the write current, which is made to flow to the current path during the selection time, is current having a relatively large value of current to which a predetermined offset current is added. Thereby, even if a small drive current is supplied to the optical elements at the time of low gray-scale, the current value of the write current to be made to flow to the current path can be set to be relatively large, a wire capacitance that is present in the current path is charged for a short time to make it possible to shorten the time required for the writing operation of gray-scale display data. This makes it possible to increase display response speed, improve display quality at the time of low gray-scale, and obtain good display quality even on the high definition display panel.

Moreover, as compared with the drive current according to the gray-scale of display data, the write current to which the fixed offset current is added is made to flow to the current path, so that an increase in the write current at the time of upper gray-scale can be suppressed to make it possible to control an increase in the power consumption of the display device.

Additionally, in the aforementioned embodiment, the explanation has been given using the circuit structure having three thin-film transistors as the pixel drive circuit. However, the present invention is not limited to this embodiment. The other circuit structure may be provided if the display device has the pixel drive circuit to which the current designation system is applied and the circuit structure has a drive control transistor for controlling the supply of the drive current to the light-emitting device and a write control transistor for controlling the gate voltage of the drive control transistor, and the write current corresponding to display data is charged to a capacitor (for example, parasitic capacitance) added to each control transistor as a voltage component, thereafter the drive control transistor is turned on to supply the drive current according to the charged voltage, thereby emitting the light-emitting device with predetermined luminance.

As explained above, according to the display device of the present invention and the driving method thereof, in the display device having a display panel in which light-emitting devices, which perform self-luminous light emission with predetermined luminance according to a value of current to be supplied, such as organic EL devices, light-emitting diodes and the like are arranged in a matrix form, since it is structured such that the drive current, which is smaller than the write current to the display pixel by a fixed offset current, is supplied to the light-emitting device by the pixel drive circuit added to each display pixel, even if display data having the lowest luminous gray-scale is written, relatively large current is made to flow, thereby making it possible to charge the capacitance components added to the data line and pixel drive circuit and to shorten the time required for a writing operation.

Moreover, in contrast to the drive current for emitting light with luminance corresponding to predetermined display data, the write current to which a fixed offset current is added may be made to flow to each display pixel. For this reason, as compared with the pixel drive circuit using the current mirror system that needs the write current in a predetermined multiple amount of drive current, it is possible to relatively suppress the write current and control power consumption of the display device.

Moreover, the switch circuit includes the current path control transistor, and the current storage circuit includes a write current storage circuit having a drive control transistor and a first capacitor device accompanying the drive control transistor to store current data corresponding to the write current, and an offset current storage circuit having a write control transistor, which is controlled by a scan signal and which controls the drive control transistor, and a second capacitor device accompanying the write control transistor and that stores current data corresponding to the offset current. A pixel drive circuit including these components can be formed by three transistors. Accordingly, an area for the pixel drive circuit can be made relatively small, and the percentage of the light-emitting area in the display pixel can be made relatively large, thereby making it possible to improve brightness of the display panel. Moreover, the amount of current to pass per unit area of the optical element can be reduced, so that the life of the optical element can be increased.

Furthermore, the second capacitor device is structured to have a capacitive value, which is equal to or larger than the first capacitor device, and since the offset current is set based on a capacitive ratio between the first capacitor device and the second capacitor device and variation in electrical potential of the scan signal during the selection time and non-selection time, this can be used as a fixed value that is set by a design value.

Thus, according to the present invention, in the display device that controls the optical elements using the current designation system, it is possible to obtain good display quality even at the time of low gray-scale and suppress the increase in the power consumption of the display device.

BEST MODE OF CARRYING OUT THE INVENTION

Figure 1:
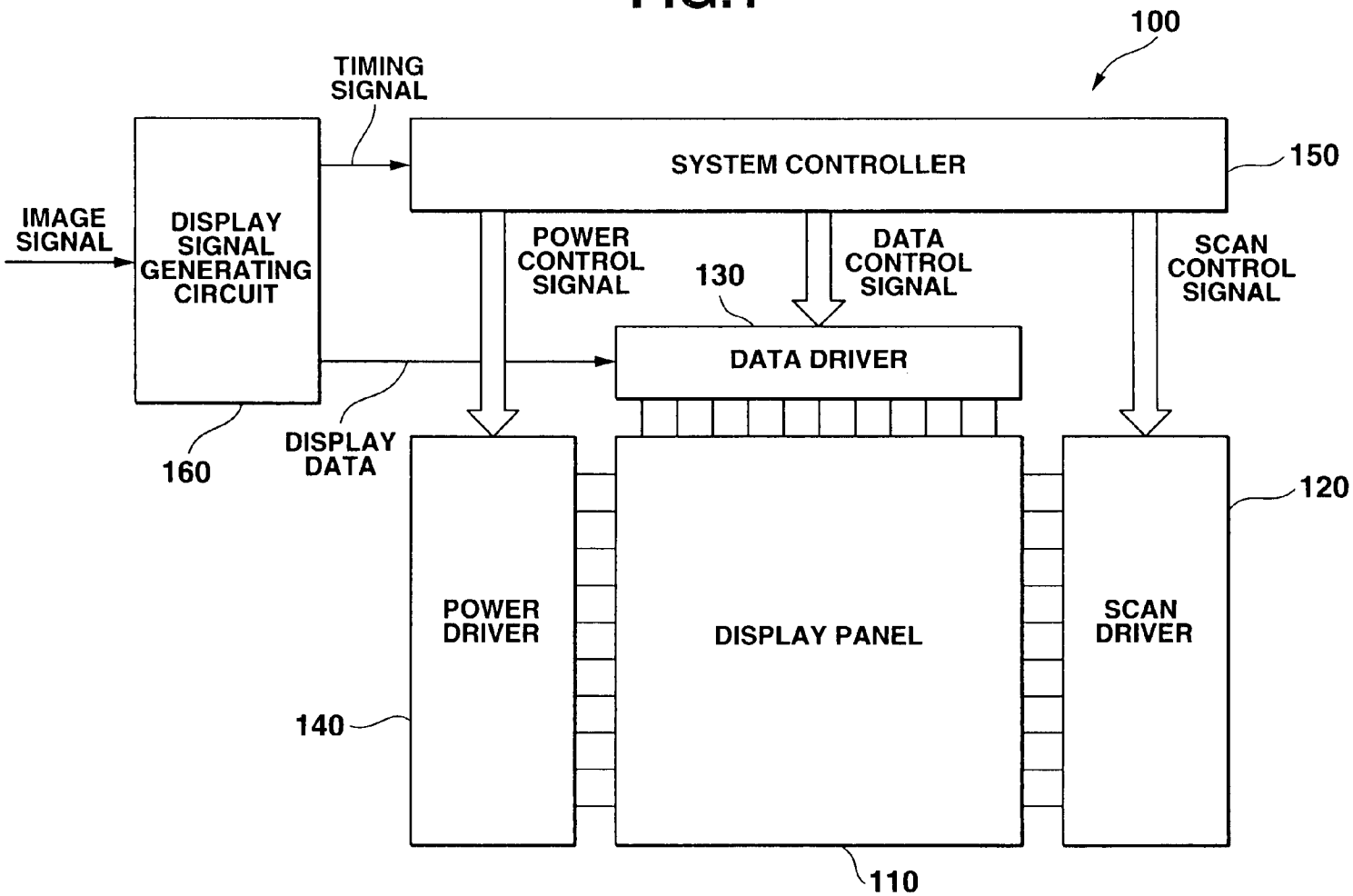
FIG. 1 is a schematic block diagram illustrating one example of the general structure of a display device according to the present invention.

The following will explain the details on the display device and the display device driving method according to the present invention based on the embodiment illustrated in the drawings.

<General Structure>

First of all, an explanation will be given of the general structure applied to the display device according to the present invention with reference to the drawings.

FIG. 1 is a schematic block diagram illustrating one example of the general structure of a display device according to the present invention.

Figure 2:
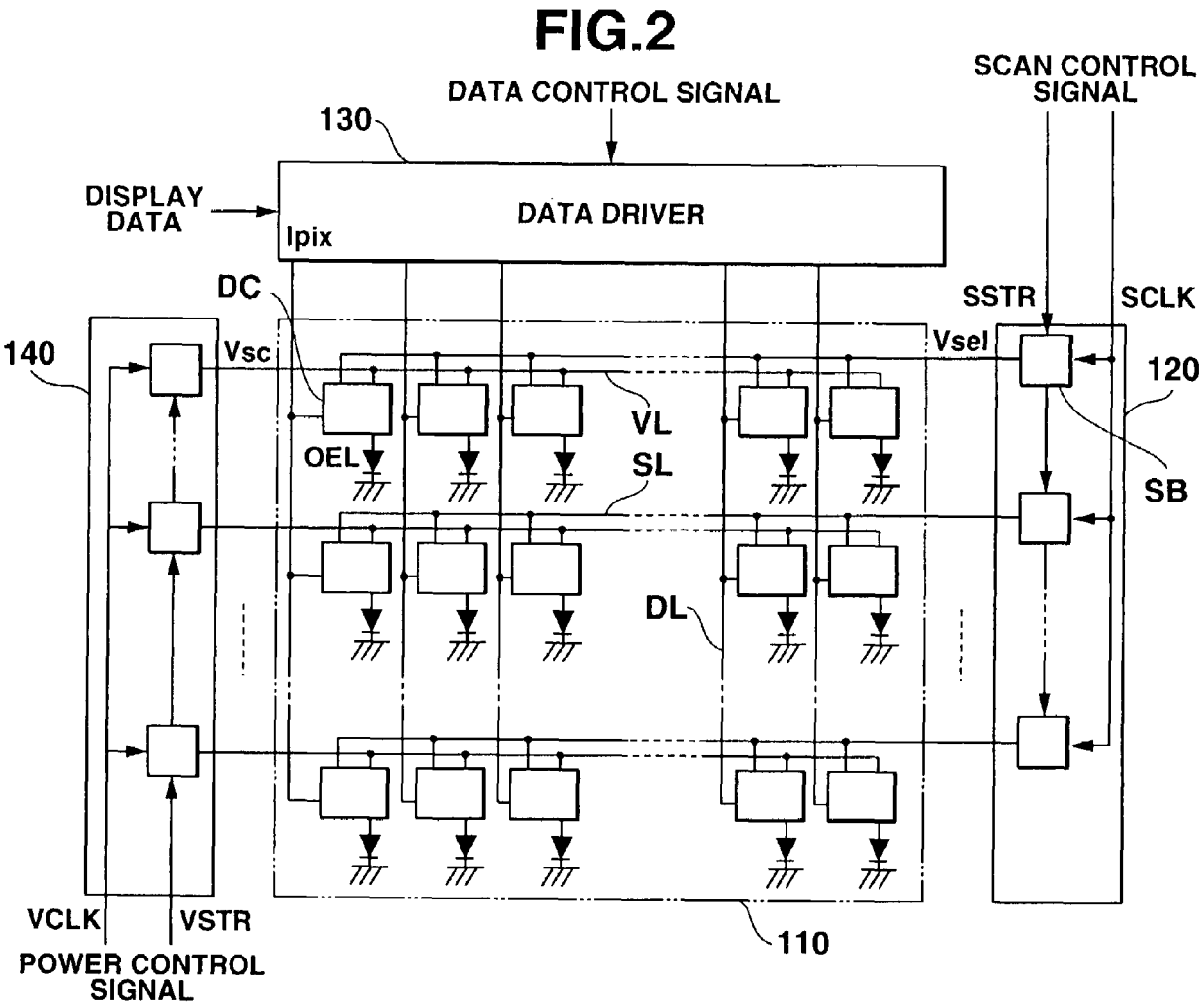
FIG. 2 is a schematic diagram illustrating one example of a display panel applied to the display device according to the present embodiment.

FIG. 2 is a schematic diagram illustrating one example of a display panel applied to the display device according to the present embodiment. Hereinafter, the same components as those of the aforementioned prior art will be explained using the same reference numerals as those of the aforementioned prior art added to the same components as those thereof.

As illustrated in FIG. 1 and FIG. 2, a display device 100 according to the present invention includes a display panel (pixel array) 110, a scan driver 120, a data driver 130, a power driver 140, a system controller 150, and a signal generating circuit 160.

In the display panel 110, a plurality of display pixels, each having a pixel drive circuit DC to be described later and a light-emitting device (optical element) OEL formed of an organic EL device, are arrayed in a matrix form in the vicinity of each intersection point of plural scan lines SL and power lines VL, which are arrayed in parallel to each other, and data lines (current lines) DL. The scan driver 120 is connected to the scan lines SL of the display panel 110, and controls a group of display pixels to be a selection state for each row by applying highlevel scan signals Vsel to the scan lines SL with predetermined timing, sequentially. The data driver 130 is connected to the data lines DL of the display panel 110, and controls a signal current (gray-scale current Ipix) supply state in accordance with display data to the data lines DL. The power driver 140 is connected to the power lines VL arrayed in parallel to the scan lines SL of the display panel 110, and makes predetermined signal currents (gray-scale current, drive current) to flow to the group of the display pixels in accordance with display data by applying high-level or low-level power voltages Vsc to the power lines VL with predetermined timing, respectively. The system controller 150 generates and outputs a scan control signal and a data control signal, which control the operation states of at least the scan driver 120 and data driver 130 and power driver 140, and a power control signal based on a timing signal supplied from the display signal generating circuit 160 to be described later. The display signal generating circuit 160 generates display data and supplies it to the data driver 130, and generates or extracts a timing signal (system clock signal and the like), which image-displays the display data to the display panel 110, and supplies it to the system controller 150 based on an image signal supplied from the external section of the display device 100.

<Structure of Each Component>

An explanation will be next given of the respective components that structure the aforementioned display device.

Figure 3:
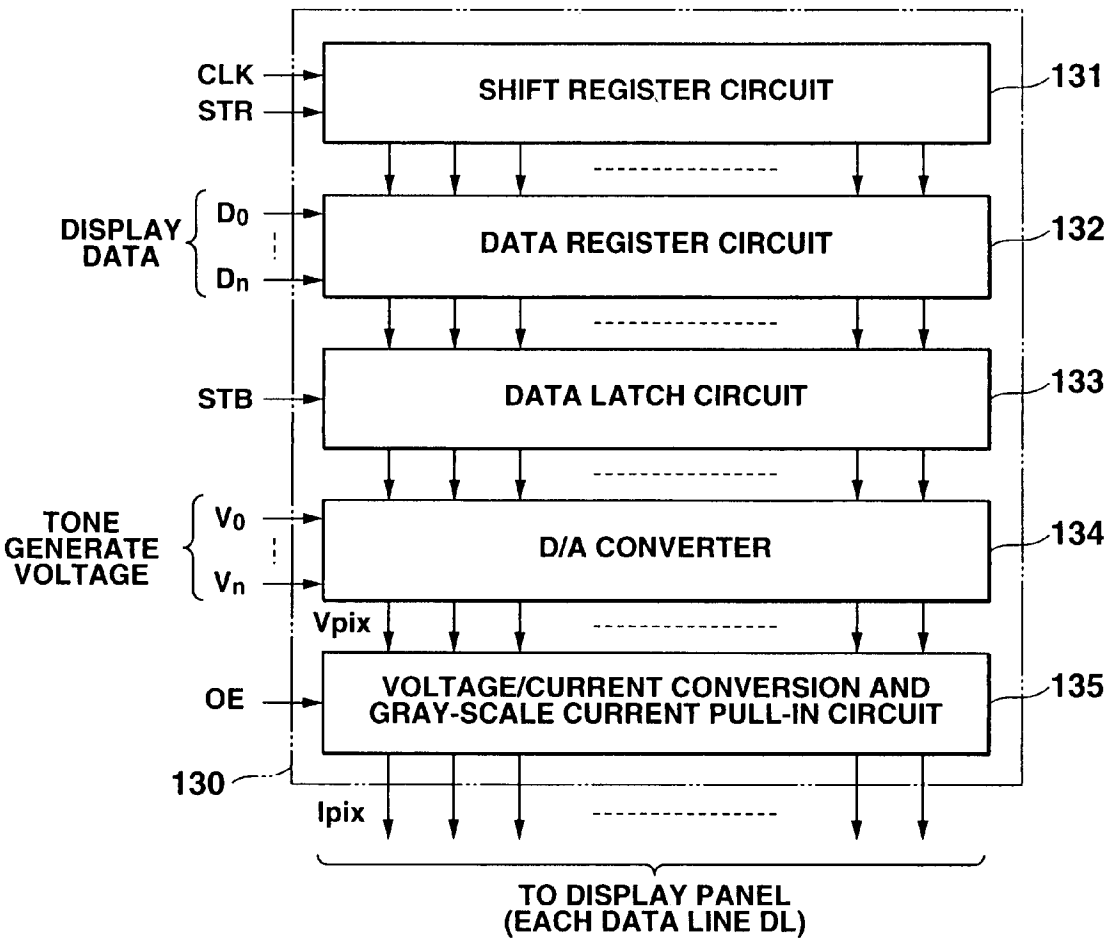
FIG. 3 is a block diagram illustrating the main structure of a data driver applied to the display device according to the present embodiment.

FIG. 3 is a block diagram illustrating the main structure of a data driver applied to the display device according to the present embodiment.

Figure 4:
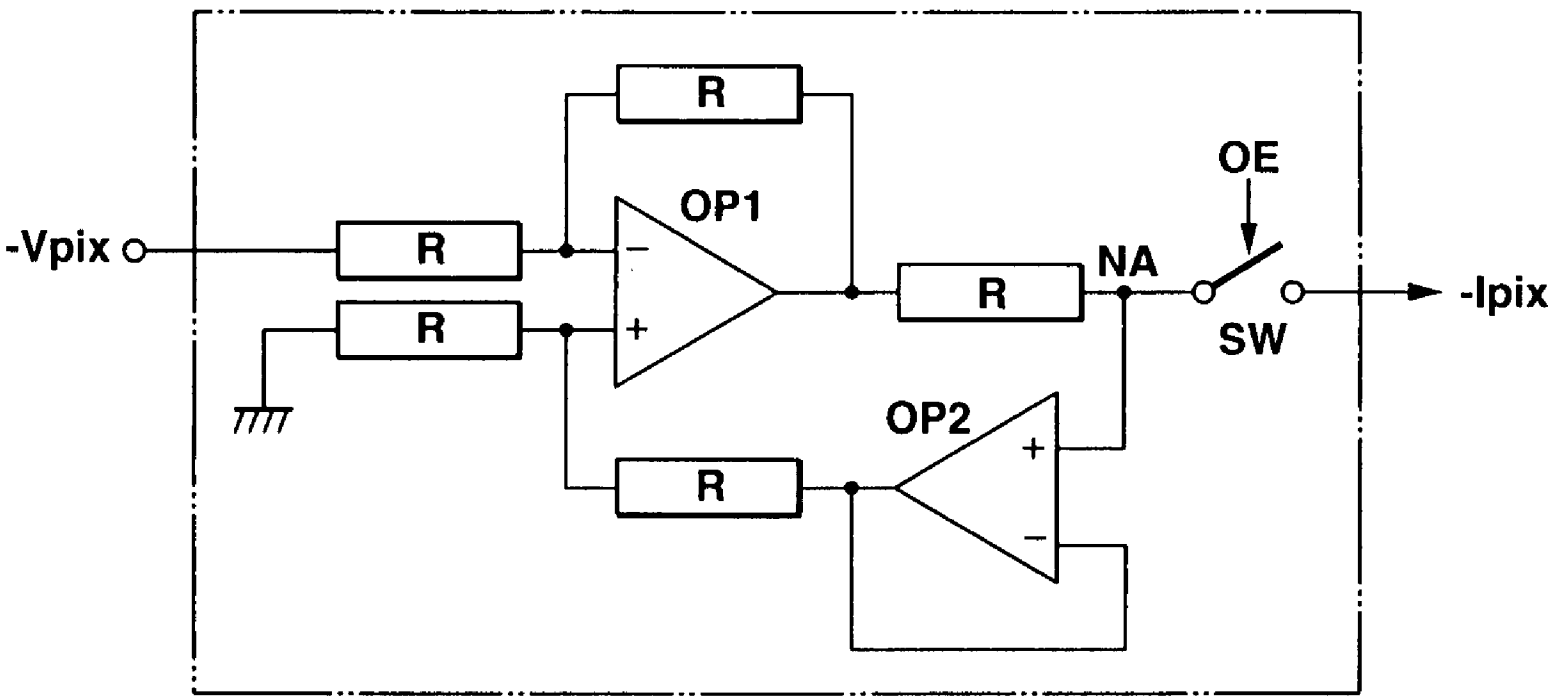
FIG. 4 is a circuit diagram illustrating one example of a voltage/current converting circuit applied to the data driver according to the present embodiment.

FIG. 4 is a circuit diagram illustrating one example of a voltage/current converting circuit applied to the data driver according to the present embodiment.

Figure 5:
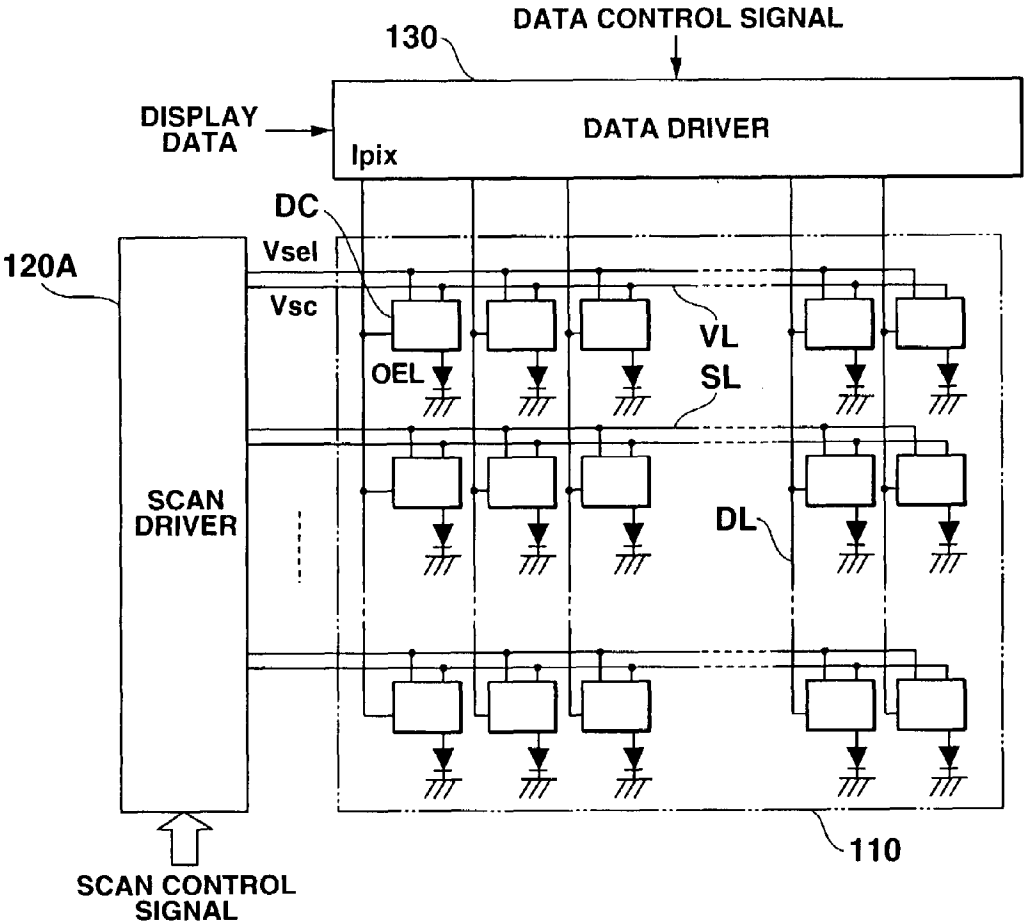
FIG. 5 is a schematic diagram illustrating another example of a scan driver applied to the display device according to the present embodiment.

Moreover, FIG. 5 is a schematic diagram illustrating another example of a scan driver applied to the display device according to the present embodiment.

(Display Panel)

As illustrated in FIG. 2, the display pixels arrayed on the display panel in a matrix form are structured to have the pixel drive circuits DC, which control the writing operation to the display pixel and the light-emitting operation of the light-emitting device, and light-emitting devices (organic EL device OEL) with luminance, which is controlled according to a current value of the drive current to be supplied, based on scan signals Vsel applied to the scan lines SL from the scan driver 120, signal currents supplied to the data lines DL from the signal driver 130, and power voltages Vsc applied to the power lines VL from the power driver 140.

Herein, the pixel drive circuit DC schematically has functions of controlling the selection/non-selection state of the display pixel based on the scan signal, fetching the gray-scale current according to display data in the selection state to hold it as a voltage level, and maintaining the operation for performing light-mission of the light-emitting devices by making the drive current to flow according to the held voltage level in the non-selection state.

Additionally, the example of the circuit structure and the circuit operation of the pixel drive circuit will be specifically described later.

Moreover, in the display device according to the present invention, as the light-emitting devices that are subjected to light-emission control by the pixel drive circuit, it is possible to satisfactorily use self-luminous light-emitting devices such as organic EL devices and light-emitting diodes explained in the prior art.

(Scan Driver)

The scan driver 120 applies high-level scan signals Vsel to the scan lines SL sequentially based on the scan control signal supplied from the system controller 150, thereby controlling the gray-scale current Ipix, that is based on display data supplied from the data driver 130 via the data lines DL, to be written onto the display pixel after the display pixel for each row is set to the selection state.

More specifically, as shown in FIG. 2, the scan driver 120 includes a plurality of stages of shift blocks SB1, SB2, . . . , each having a shift register and a buffer, to correspond to each scan line SL. Based on the scan control signals (scan start signal SSTR, scan clock signal SCLK, and the like) supplied from the shift controller, shift outputs, which are generated as being sequentially shifted from the upper portion of the display panel 110 to the lower portion by the shift register, are applied to the respective scan lines SL as scan signals Vsel, each having a predetermined voltage level (high level), via the buffer.

(Data Driver)

FIG. 3 is a block diagram illustrating the main structure of a data driver applied to the display device according to the present embodiment. FIG. 4 is a circuit diagram illustrating one example of a voltage/current conversion and gray-scale current pull-in circuit applied to the data driver according to the present embodiment.

Based on the data control signals (output enable signal OE, data latch signal STB, sampling start signal SRT, shift clock signal CLK, and the like) supplied from the shift controller 150, the data driver 130 latches display data supplied from the display signal generating circuit 160 with predetermined timing and hold it, converts the gray-scale voltage corresponding to the display data to a current component with predetermined timing, and supplies it to each data line DL as a gray-scale current Ipix.

More specifically, as illustrated in FIG. 3, the data driver 130 includes a shift register circuit 131, a data register circuit 132, a data latch circuit 133, a D/A converter 134, and a voltage/current conversion and gray-scale current pull-in circuit 135. The shift register circuit 131 outputs a shift signal as shifting the sampling start signal STR sequentially based on the shift clock signal CLK supplied as a data control signal from the system controller 150. The data register circuit 132 latches display data DO to Dn (digital data) for one row supplied from the display signal generating circuit 160 sequentially based on the input timing of the shift signal. The data latch circuit 133 holds display data DO to Dn for one row latched by the data register circuit 132 based on the data latch signal STB. The D/A converter 134 converts the above-held display data DO to Dn to a predetermined analog signal voltage (gray-scale voltage Vpix) based on gray-scale generating voltages V0 to Vn supplied from power supply means (omitted in the figure). The voltage/current conversion and gray-scale current pull-in circuit 135 generates a gray-scale current Ipix corresponding to display data converted to the analog signal voltage, and supplies the gray-scale current Ipix via the data lines DL arrayed on the display panel 110 based on the output enable signal OE supplied from the system controller 150 (in the present embodiment, the gray-scale current Ipix is pulled in by generating a signal current with a negative polarity as the gray-scale current Ipix).

Herein, as a circuit structure, which is applicable to the voltage/current conversion and gray-scale current pull-in circuit 135 and which is connected to each data line, for example, there are provided an operational amplifier OP1 where gray-scale voltage with a reverse polarity (−Vpix) is input to one input terminal (negative input (−)) via an input resister R, reference voltage (ground potential) is input to the other input terminal (positive input (+)) via the input resister R and an output terminal is connected to one input terminal (−) via a feedback resister R, an operational amplifier OP2 where potential of node NA, which is formed at the output terminal of the operational amplifier OP1 via an output resister R, is input to one input terminal (+), an output terminal is connected to the other input terminal (−), reference voltage (ground potential) is input to the other input terminal (+) of the operational amplifier OP1 via the input resister R and an output terminal is connected to one input terminal via the feedback resister R, and switching means SW that provides ON/OFF operation to the node NA based on the output enable signal OE supplied from the system controller 150 to attain a state that the gray-scale current Ipix is supplied to the data line DL (in the present embodiment, since the gray-scale current Ipix to be generated has the negative polarity, the relevant current is pulled in).

According to such the voltage/current conversion and gray-scale current pull-in circuit, the gray-scale current with a negative polarity formed of −Ipix=(−Vpix)/R is generated to the gray-scale voltage with a negative polarity to be input (−Vpix) and supplied to the data lines DL based on the output enable signal OE.

Therefore, according to the data driver 130 of the present embodiment, the gray-scale voltage corresponding to display data is converted to the gray-scale current (negative polarity) and the resultant is supplied to the data line DL with predetermined timing, thereby control is performed such that the gray-scale current Ipix corresponding to display data is made to flow in a current pull-in direction to the data driver 130 side from the data line DL side.

(System Controller)

The system controller 150 outputs scan control signals that controls the operation state and data control signals (the aforementioned scan shift start signal SSTR, scan clock signal SCLK, shift start signal STR, shift clock signal CLK, latch signal STB, output enable signal OE, and the like), and power control signals (power start signal VSTR to be described later, power clock signal VCLK and the like) to each of the scan driver 120, data driver 130, and power driver 140, thereby operating each driver with predetermined timing to generate and output a scan signal Vsel, gray-scale current Ipix and power voltage Vsc, and to cause a pixel drive circuit to be described later to execute a drive control operation (display device driving method), thereby performing such control that displays image information, which is based on a predetermined image signal, on the display panel 110.

(Power Driver)

The power driver 140 applies a low-level power voltage Vscl (for example, voltage level below the ground potential) to the power line VL in synchronization with timing when the group of display pixels for each row is set to the selection state by the scan driver 120 based on the power control signal supplied from the system controller 150, thereby pulling a write current (sink current) corresponding to the gray-scale current Ipix, which is based on display data, in the direction of data driver 130 via the display pixel (pixel drive circuit) from the power line VL. Meanwhile, the power driver 140 applies a high-level power voltage Vsch to the power line VL in synchronization with timing when the group of display pixels for each row is set to the non-selection state by the scan driver 120, thereby controlling such that the drive current corresponding to the gray-scale current Ipix, which is based on display data, in the direction of the light-emitting device (organic EL device OEL) via the display pixel (pixel drive circuit) from the power line VL.

As schematically illustrated in FIG. 2, similar to the aforementioned scan driver 120, the power driver 140 includes a plurality of stages of shift blocks SB1, SB2, . . . , each having a shift register and a buffer, to correspond to each scan line SL. Based on the power control signals (power start signal VSTR, power clock signal VCLK, and the like) that synchronize with the scan control signals supplied from the system controller, shift outputs, which are generated as being sequentially shifted from the upper portion of the display panel 110 to the lower portion by the shift register, are applied to the respective power lines VL as power signals Vscl and Vsch, each having a predetermined voltage level (low level in the selection state and high level in the non-selection state by the scan driver), via the buffer.

(Display Signal Generating Circuit)

The display signal generating circuit 160 extracts a luminous gray-scale signal component from an image signal supplied from the external section of the display device, and supplies it to the data register circuit 132 of the data driver 130 as display data every one row of the display panel 110. In a case where the above-mentioned image signal includes a timing signal component that defines display timing of image information as in a TV broadcast signal (composite image signal), the display signal generating circuit 160 may one that has a function of extracting a timing signal component to supply to the system controller 150 in addition to the function of extracting the aforementioned luminous gray-scale signal component. In this case, the system controller 150 generates a scan control signal and a data control signal and a power control signal, which are supplied to the scan driver 120, data driver 130 and power driver 140, based on the timing signal supplied from the display signal generating circuit 160.

The present embodiment has explained the structure in which the scan driver 120, data driver 130 and power driver 140 are individually arranged as the drivers provided around the display panel 110. However, the present invention is not limited to this. As mentioned above, since the scan driver 120 and power driver 140 operate based on the equivalent control signals (scan control signal and power control signal) whose timing is synchronized with each other, it is possible to use, for example, as illustrated in FIG. 5, one that is structured to have a function of supplying power voltage Vsc in synchronization with the generation of scan signal and output timing in a scan driver 120A. According to such a structure, the peripheral circuit structure can be simplified.

An explanation will be next given of an embodiment of the pixel drive circuit applied to the aforementioned display pixel with reference to the drawings.

<Pixel Drive Circuit>

(Circuit Structure)

Figure 6:
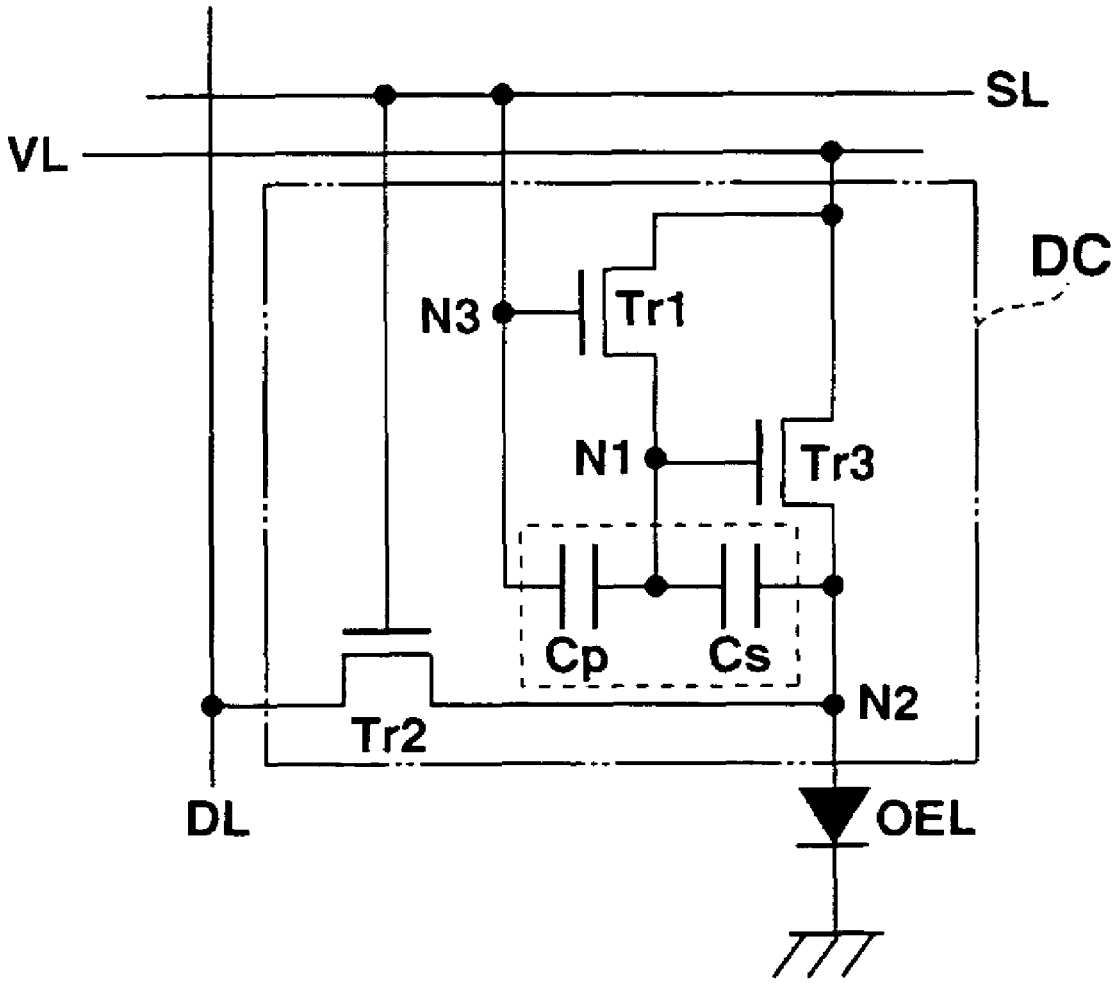
FIG. 6 is a circuit diagram illustrating an embodiment of the display pixel applicable to the display device according to the present invention.

FIG. 6 is a circuit diagram illustrating an embodiment of the display pixel applicable to the display device according to the present invention.

Figure 7A:
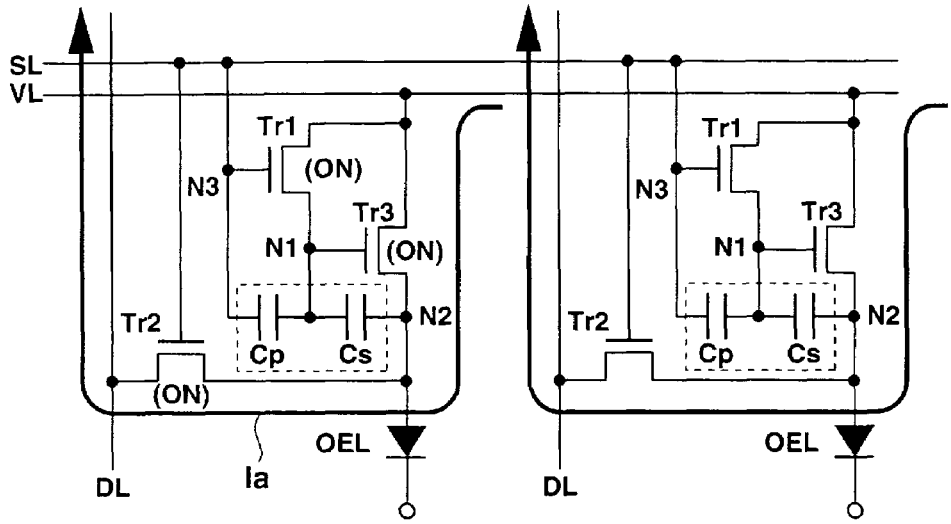
FIGS. 7A and 7B are conceptual views each illustrating an operation in a pixel drive circuit according to this embodiment.
Figure 7B:
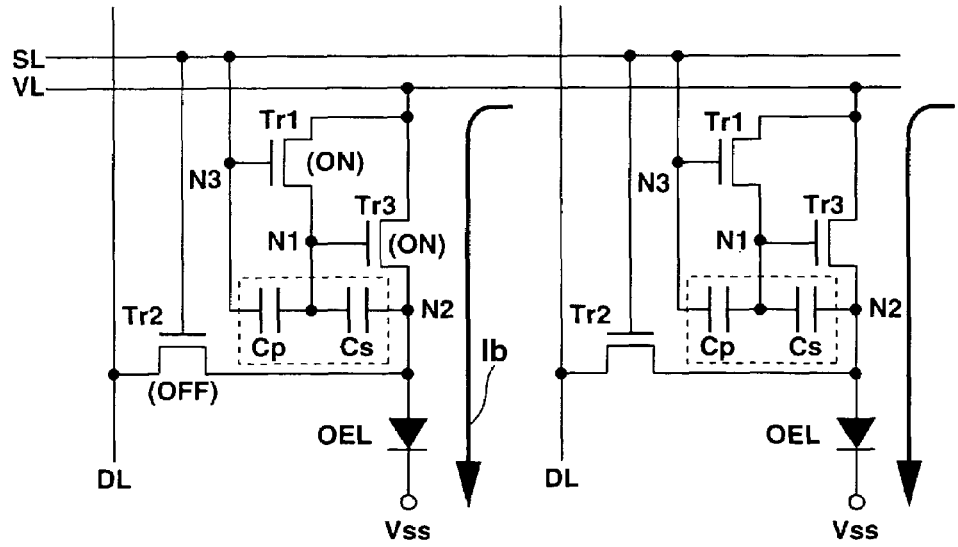

FIGS. 7A and 7B are conceptual views each illustrating an operation in a pixel drive circuit according to this embodiment.

Figure 8:
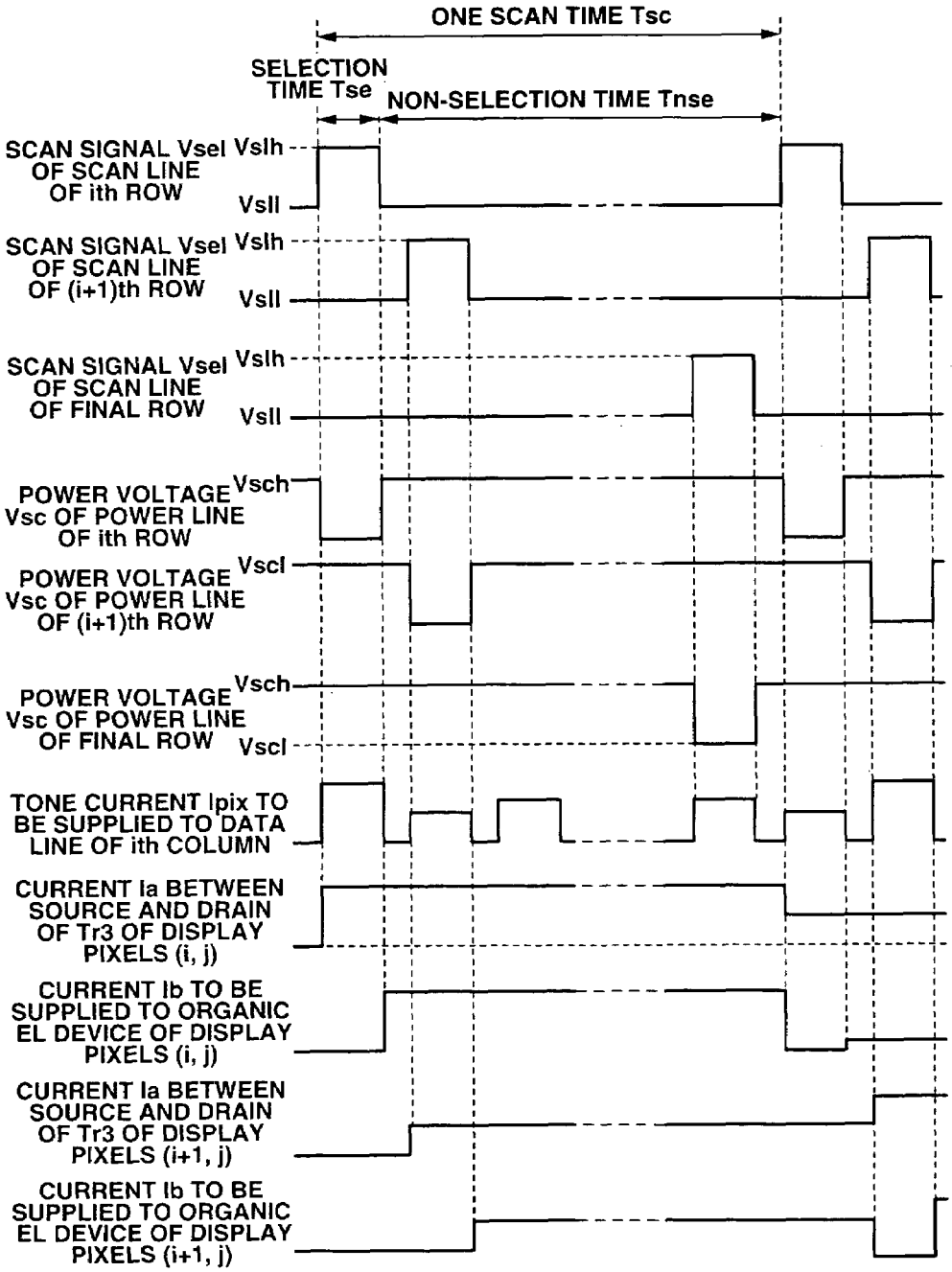
FIG. 8 is a timing chart showing display timing of image information in the display device according to the present embodiment.

FIG. 8 is a timing chart showing display timing of image information in the display device according to the present embodiment.

Figure 9:
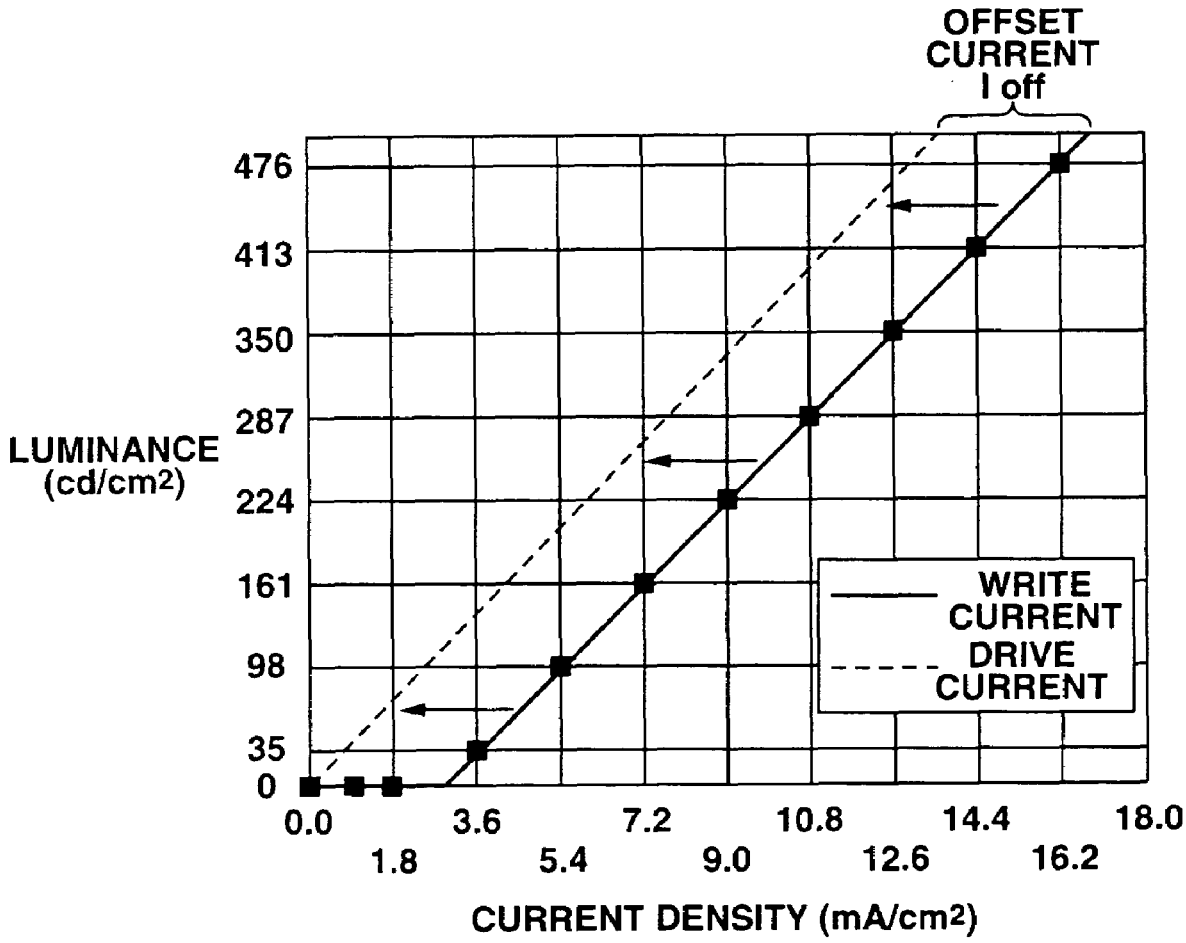
FIG. 9 is a graph showing an amount of change between a write current and a drive current in the pixel drive circuit according to the present embodiment.

FIG. 9 is a graph showing an amount of change between a write current and a drive current in the pixel drive circuit according to the present embodiment.

As illustrated in FIG. 6, in the vicinity of each intersection point of the scan lines SL and data lines DL, which are arrayed on the display panel 110 to be perpendicular to each other, the pixel drive circuit DC according to the present embodiment includes:

a thin-film transistor (write control transistor) Tr1 where a gate terminal is connected to the scan line SL and a source terminal is connected to the power line VL, and a drain terminal is connected to a node N1, respectively, a thin-film transistor (current path control transistor) Tr2 where a gate terminal is connected to the scan line SL, and a source terminal and a drain terminal are connected to the data line DL and a node N2, respectively;

a thin-film transistor (drive control transistor) Tr3 that controls supply of a drive current Ib to the light-emitting device (organic EL device OEL: optical element) to be described later where a gate terminal is connected to the node N1 and a source terminal and a drain terminal are connected to the power line VL and the node N2, respectively;

a capacitor (first capacitive device) Cs connected between the gate terminal (node N1) of the thin-film transistor (drive control transistor) Tr3 and the source terminal (node N2); and a capacitor (second capacitive device) Cp connected between the gate terminal (node N3) of the thin-film transistor (write control transistor) Tr1 and the source terminal (node N1), wherein an anode terminal of the light-emitting device (organic EL device OEL: optical element) and a cathode terminal are connected to the node N2 and ground potential, respectively.

Here, the capacitor Cs may be a parasitic capacitance that is formed between the gate and source of the thin-film transistor Tr3, and one in which a capacitive device is further added therebetween may be used. Moreover, the capacitor Cp may be a parasitic capacitance that is formed between the gate and source of the thin-film transistor Tr1, and one in which a capacitive device is further added between the gate and source may be used.

In this case, the capacitor Cp (for example, parasitic capacitance) formed between the gate and source of the thin-film transistor Tr1 has generally an influence upon the device characteristic of the thin-film transistor to degrade the operation characteristic of the thin-film transistor. For this reason, the capacitor Cp is normally designed to reduce such degrade to a minimum. However, the present invention is characterized in that the effect produced by the capacitor Cp (effect produced by voltage charged to the capacitor Cp at the time of writing operation though this is described later) is positively used. Accordingly, in the present invention, the capacitance value of the capacitor Cp is designed to be large to some extent. More specifically, the capacitance value of the capacitor Cp is designed to be large to some extent that is not negligible as compared to the capacitor Cs added to the thin-film transistor (drive control transistor) Tr3. For example, in the present embodiment, there is provided such a structure that is designed to attain an equivalent value; Cp≈Cs.

In addition, the circuit structure including the thin-film transistor Tr3 and the capacitor Cs forms the write current storage circuit according to the present invention, the circuit structure including the thin-film transistor Tr1 and the capacitor Cp forms the offset current storage circuit according to the present invention, and the circuit structure including the thin-film transistor Tr2 forms the switch current circuit according to the present invention.

(Circuit Operation)

An explanation will be next given of the light-emission drive control operation of the light-emitting device by the pixel drive circuit DC.

For example, as illustrated in FIG. 8, the light-emission drive control of the light-emitting device (organic EL device) by the pixel drive circuit DC is executed by setting a writing operation time (or display pixel selection time) Tse where one scan time Tsc is one cycle, a group of display pixels connected to a specific scan line is selected to write a signal current corresponding to display data and hold it as signal voltage within one scan time Tsc, and a light-emission operation time (display pixel non-selection time) Tnse where a drive current corresponding to the above display data is supplied to the organic EL device to perform light-emission operation with a predetermined luminous gray-scale based on the signal voltage written and held during the writing operation time (Tsc=Tse+Tnse). In this case, the write operation time Tse, which is set for each row, is provided not to cause an overlap of time.

(Write Operation Time: Selection Time)

First, during the display pixel write operation time (selection time Tse), as illustrated in FIG. 8, a high-level scan signal Vsel (Vslh) is applied to the scan line SL of a specific row (ith row) from the scan driver 120, and low-level power voltage Vscl is applied to the power line VL of the relevant row (ith row) from the power driver 140.

Moreover, in synchronization with this timing, gray-scale current (−Ipix) with a negative polarity, corresponding to display data of the relevant row (ith row) fetched by the data driver 130, is supplied to each data line DL.

This turns on the thin-film transistors Tr1 and Tr2, which form the pixel drive circuit DC, so that the low-level power voltage Vscl is applied to the node N1, namely, the gate terminal of the thin-film transistor Tr3 and one end of the capacitor Cs, and the operation to pull in the gray-scale current (−Ipix) with a negative polarity via the data line DL is performed, thereby the voltage level of the potential, which is lower than the low-level power voltage Vscl, is applied to the node N2, namely, the source terminal of the thin-film transistor Tr3 and the other end of the capacitor Cs.

Thus, the potential difference occurs between the nodes N1 and N2 (between the gate and the source of the thin-film transistor Tr3) and the thin-film transistor Tr3 is thereby turned on, and a write current Ia corresponding to gray-scale current Ipix is supplied to the data driver 130 from the power line VL via the thin-film transistor Tr3, node N2, thin-film transistor Tr2, and data line DL as illustrated in FIG. 7A.

At this time, the gate voltage (potential of node N1) Vg of the thin-film transistor Tr3 reaches a voltage value, which is necessary to pass the write current Ia between the drain and source (current path) of the thin-film transistor Tr3, and an electrical charge, corresponding to the gate voltage Vg, as current data is charged to the capacitor Cs formed between the gate and source of the thin-film transistor Tr3.

Moreover, in a state that the gate voltage Vg of the thin-film transistor Tr3 is held, an electrical charge corresponding to a potential difference between the gate voltage (high-level scan signal Vsel) of the thin-film transistor Tr1 and the source voltage (gate voltage Vg of the thin-film transistor Tr3) as current data is charged to the capacitor Cp as a voltage component.

In addition, during the selection time Tse, power voltage Vsel having a voltage level, which is below the ground potential, is applied to the power line VL, and the write current Ia is controlled to flow in the direction of the data line DL. For this reason, potential to be applied to the anode terminal (node N2) of the light-emitting device (organic EL device OEL) becomes lower than the potential (ground potential) of the cathode terminal and a reverse bias voltage is applied to the light-emitting device (organic EL device OEL). Accordingly, no drive current flows to the light-emitting device (organic EL device OEL), and the light-emitting operation of the light-emitting device is not performed.

(Light-Emitting Operation Time: Non-Selection Time)

Next, during the light-emitting operation time (non-selection time Tnse) of the organic EL device after the write operation time (selection time Tse), as illustrated in FIG. 8, a low-level scan signal Vsel (Vsll) is applied to the scan line SL of a specific row (ith row) from the scan driver 120, and high-level power voltage Vsch is applied to the power line VL of the relevant row (ith row) from the power driver 140. Moreover, in synchronization with this timing, the pull-in operation of gray-scale current by the data driver 130 is stopped.

This turns off the thin-film transistors Tr1 and Tr2, which form the pixel drive circuit DC, so that the application of power voltage Vsc to the node N1, namely, the gate terminal of the thin-film transistor Tr3 and one end of the capacitor Cs is interrupted, and the application of the voltage level to the node N2, namely, the source terminal of the thin-film transistor Tr3 and the other end of the capacitor Cs, which is caused by the pull-in operation of the gray-scale current by the data driver 130, is interrupted. For this reason, the capacitors Cs and Cp hold the electrical charges stored by the aforementioned writing operation. In this case, as described later, an influence, which is based on the fact that the potential of the scan signal Vsel changes to the low level (Vsll) from the high level (vslh) during the selection time to non-selection time, occurs on the voltage across the capacitor Cs. The voltage across the capacitor Cs reduces and the voltage between the gate and source of the thin-film transistor (drive control transistor) Tr3 lowers as compared with the voltage at the write operation time.

Namely, the electrical charge applied to the capacitor Cs is held during the non-selection time. Thereby, the on-state of the thin-film transistor Tr3 is maintained, and the power voltage Vsch with voltage level (high level) higher than the ground potential is applied to the power line VL. As a result, the bias voltage is applied to the light-emitting device in a forward direction and the light-emitting device emits light with luminance, which is based on the drive current I supplied from the thin-film transistor Tr3. However, at this time, the drive current Ib to be supplied to the light-emitting device is set to a current value corresponding to one that is reduced by current (offset current), which is set based on the potential changes of the capacitor Cp formed between the gate and source of the thin-film transistor (write control transistor) Tr1 and the scan signal Vsel during the selection time and non-selection time, from the write current Ia passing through the thin-film transistor (drive control transistor) Tr3 by the aforementioned writing operation.

Then, a series of these operations is repeatedly executed in connection with the groups of display pixel of all rows that form the display panel as illustrated in FIG. 8, thereby display data for one screen of the display panel is written, light-emission is performed with predetermined luminous gray-scale, so that desired image information is displayed.

(Relationship Between Capacitors Cs, Cp and Offset Current)

An explanation will be next given of the relationship between capacitors Cs, Cp and offset current that are applied to the pixel drive circuit shown in the present embodiment.

Here, it is assumed that the following drive conditions are given. Namely, at the write operation time, the signal level of 5V is applied as high-level scan signal Vsel(Vslh), the write current Ia passes through the pixel drive by pulling in the gray-scale current Ipix, so that the signal level of −15V is applied to the source terminal (node N2) of the light-emitting device Tr3. At the light-emitting operation time after the writing operation, the signal level of −20V is applied as low-level scan signal Vsel(Vsll), the gray-scale current Ipix is stopped to be pulled in, so that the flow of the gray-scale current Ipix is interrupted and the signal level of 5V is held at the source terminal of the thin-film transistor Tr3.

In this case, first of all, at the write operation time, electrical charges (current data), which shown in the left side of equation (1), are stored in the capacitor devices Cp and Cs in accordance with the potential of each node. Sequentially, the electrical charges stored in the capacitor devices Cp and Cs at the light-emitting operation time reach electrical charges, which shown in the right side of equation (1) in accordance with the electrical charges stored at the write operation time. Accordingly, the relationship shown in the following equation (1) can be obtained.

$$Cp(Vg1-Vslh)+Cs(Vg1-Vs1)=Cp(Vg2-Vsll)+Cs(Vg2-Vs2) \quad (1)$$

where Vg1 is the potential of node N1 (the gate voltage of the thin-film transistor Tr3) at the write operation time and Vg2 is the potential of node N1 at the light-emitting operation time. Moreover, Vslh is the high-level scan signal at the write operation time and Vsll is the low-level scan signal at the light-emitting operation time. Vs1 is the potential of node N2 (the source voltage of the thin-film transistor Tr3) at the write operation time and Vs2 is the potential of node N2 at the light-emitting operation time.

The variation ΔVg in the gage voltage Vg of the thin-film transistor Tr3 at the write operation time and the light-emitting operation time can be expressed by the following equation (21) from the above equation (1).

$$\Delta Vg=(Cp\times\Delta Vsel+Cs\times\Delta Vs)/(Cs+Cp) \quad (2)$$

where ΔVg=Vg1−Vg2, ΔVs=Vs1−Vs2, ΔVsel=Vslh−Vsll.

Here, in the above equation (2), if the capacitor device Cp is set to have a small capacitance value that is negligible as compared to the capacitance value of the capacitor device Cs (Cs >>Cp), the equation (2) can be approximately expressed by the following equation (3).

$$\Delta Vg\approx(Cs\times\Delta Vs)/(Cs)=\Delta Vs \quad (3)$$

Namely, in this case, the variation in the gage voltage Vg of the thin-film transistor Tr3 and the variation in the source voltage Vs at the write operation time and the light-emitting operation time are substantially equal to each other. For this reason, the voltage Vgs between the gate and source of the thin-film transistor Tr3 does not change as shown in the following equation (4).

$$\Delta Vgs=\Delta Vg-\Delta Vs\approx 0 \quad (4)$$

From this fact, the voltage, which is written to the gate terminal of the thin-film transistor Tr3 at the write operation time, namely, the voltage charged to the capacitor device Cs is applied as it is even at the light-emitting operation time. The drive current Ib to be supplied to the light-emitting device at the light-emitting operation time becomes equal to the write current Ia passing through the pixel drive circuit at the write operation time. Accordingly, in this case, if display data having the minimum luminous gray-scale is written to the display pixel, the write current Ia, which equal to the small drive current Ib, is resultantly made to pass through the display pixel, causing a problem in which time required for the writing operation is increased.

In contrast to this, if the capacitor device Cp is set to have a capacitance value, which is large to some extent, namely, a large value that is not negligible as compared to the capacitance value of the capacitor device Cs (for example, Cs≈Cp), the above equation (4) can be rewritten by the following equation (5).

$$\begin{aligned}\Delta Vgs &= \Delta Vg-\Delta Vs \quad (5)\\ &= (Cp\times\Delta Vsel+Cs\times\Delta Vs)/(Cs+Cp)-\Delta Vs\\ &= (Cp\times\Delta Vsel+Cs\times\Delta Vs-Cs\times\Delta Vs-Cp\times\Delta Vs)/(Cs+Cp)\\ &= (Cp\times\Delta Vsel-Cp\times\Delta Vs)/(Cs+Cp)\\ &= Cp/(Cs+Cp)\times(\Delta Vsel-\Delta Vs)\end{aligned}$$

Here, if the high-level scan signal Vsel (Vslh) is set to 5V and the low-level scan signal Vsel (Vsll) is set to −20V as mentioned above, variation ΔVsel in the voltage of the scan signal Vsel can be calculated by the following equation (6), and the relationship of ΔVsel>0 can be obtained.

$$\Delta Vsel=Vslh-Vsll=5-(-20)=25 \quad (6)$$

Moreover, if the source voltage (potential of node N2) Vs1 of the thin-film transistor Tr3 at the write operation time is set to −15V and the source voltage V2 of the thin-film transistor Tr3 at the light-emitting operation time is set to 5V, variation ΔVs in the source voltage Vs can be calculated by the following equation (7), and the relationship of ΔVs<0 can be obtained.

$$\Delta Vs = Vs1 - Vs2 = (-15) - 5 = -20 \quad (7)$$

From the above point, the relationship of ΔVgs>0 can be obtained.

This means that the variation in the voltage applied at the light-emitting operation time is smaller than the variation in the voltage written to the gate terminal of the thin-film transistor Tr3 at the write operation time, and this reduces the drive current Ib passing through the organic EL device at the light-emitting operation time by predetermined current (offset current Ioff) as compared to the write current Ia passing through the pixel drive circuit at the write operation time as illustrated in FIG. 9.

Here, the value of the offset current Ioff is set based on variation ΔVgs in the voltage Vgs between the gate and source of the thin-film transistor (drive control transistor) Tr3 at the write operation time and the light-emitting operation time as mentioned above, and the value ΔVgs is set based on variation ΔVs in the source voltage of the thin-film transistor Tr3, which is basis on a capacitance ratio between the capacitor Cs (first capacitor device) and the capacitor Cp (second capacitor device), variation ΔVsel in the potential of the scan signal Vsel, and variation in the potential of the scan signal Vsel as shown in the equation (5).

Moreover, the above embodiment has explained that the capacitance value of the capacitor Cp connected between the gate and source of the thin-film transistor Tr1 has the value, which is substantially equal to that of the capacitor Cs connected between the gate and source of the thin-film transistor Tr3. However, the present invention is not limited to this, and for example, the capacitor Cp may be set to be larger than the capacitor Cs (Cs<<Cp).

In this case, the above equation (5) can be rewritten by the following equation (8).

$$\begin{aligned} \Delta Vgs &= \Delta Vg - Vs \quad (8) \\ &= Cp/(Cs + Cp) \times (\Delta Vsel - \Delta Vs) \\ &\approx \Delta Vsel - \Delta Vs \end{aligned}$$

Namely, in this case, the voltage Vgs between the gate and source of the thin-film transistor (drive control transistor) Tr3 shows variation in the voltage, which does not depend on the capacitors Cs and Cp. Accordingly, the offset current Ioff in this case is set based on only variation ΔVs in the source voltage of the thin-film transistor Tr3, which is basis on variation ΔVsel in the potential of the scan signal Vsel and variation ΔVs in the potential of the scan signal Vsel, and is not influenced by the capacitances of the capacitors Cs and Cp. Accordingly, it is possible to suppress the influence of variation in characteristics of the thin-film transistors Tr1 and Tr3 with the passage of time to stabilize the drive condition, thereby allowing the display quality to be further improved.

(Validity of the Pixel Drive Circuit of the Present Invention)

Figure 11A:
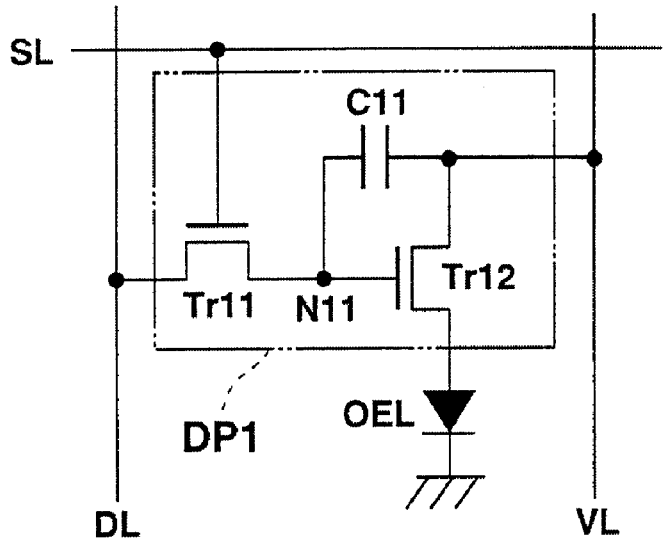
FIG.11A (PRIOR ART)
FIGS. 11A and 11B are circuit diagrams illustrating the structural example of the display pixel of the prior art in a light-emitting device type display device having an organic EL device.
Figure 11B:
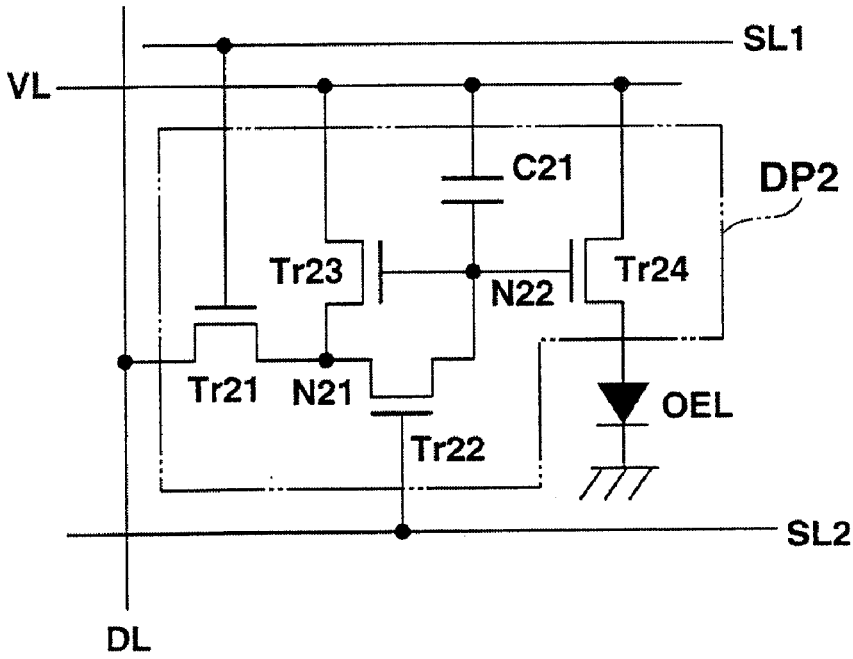
FIG.11B (PRIOR ART)

Next, the following will explain the validity of the structure of the pixel drive circuit according to the present invention in connection with the write current at the write operation time based on a comparison between the pixel drive circuit of the present invention illustrated in FIG. 6 and the pixel drive circuit having a current mirror circuit structure illustrated in FIG. 11B.

Figure 10:
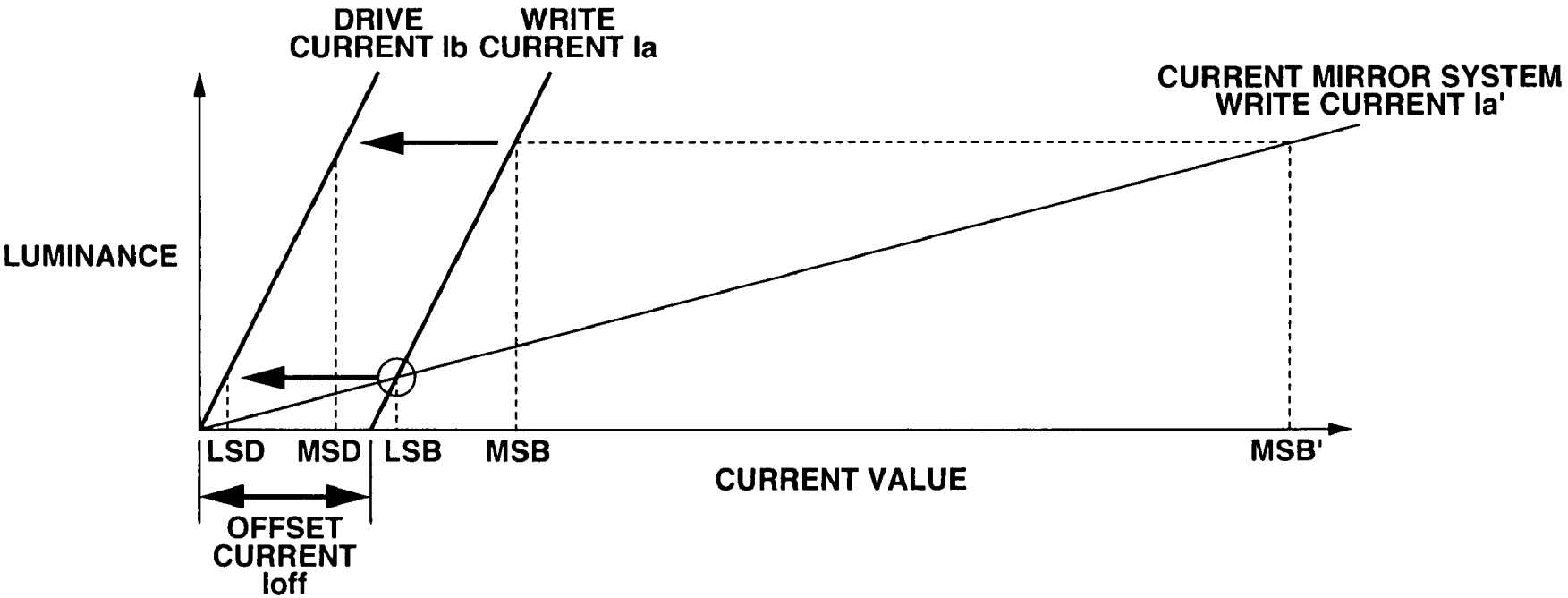
FIG. 10 is a graph showing a comparison between a current value of the write current in the case of the pixel drive circuit according to this embodiment and a current value of the write current in the case of the pixel drive circuit having a current mirror circuit structure.

FIG. 10 is a graph showing a comparison between the current value of the write current in the case of the pixel drive circuit according to this embodiment and a current value of the write current in the case of the pixel drive circuit having a current mirror circuit structure.

Here, it is assumed that a write current in the present embodiment is Ia and a drive current to be supplied to the light-emitting device is Ib as illustrated in FIG. 10. Moreover, it is assumed that a write current in the case where the current mirror structure is provided in the pixel drive circuit is Ia'

Further, it is assumed that a current value (first current value) of the write current a corresponding to luminance of the minimum gray-scale, which is required to realize a predetermined display response characteristic (response speed) of the display device, is LSB. In this case, it is assumed that a current value (second current value) of the drive current Ib to be supplied to the light-emitting device is LSD. Moreover, it is assumed that a current value of the write current Ia corresponding to luminance o the maximum gray-scale, is MSB. In this case, it is assumed that a current value of the drive current Ib to be supplied to the light-emitting device is MSD.

Still moreover, in a case where a current value of the write current Ia', which is obtained when the current mirror structure is provided in the pixel drive circuit and the current value of the drive current Ib to be supplied to the light emitting device becomes LSD, becomes the same current value LSB as in the aforementioned present embodiment, it is assumed that a current value of the write current Ia', which is obtained when the current value of the drive current Ib to be supplied to the light-emitting device becomes MSD, is MSB'.

Namely, as illustrated in FIG. 10, in the pixel drive circuit according to the present embodiment, the value of the write current Ia has a current value (second current value) in which a fixed offset current Ioff is added to the drive current Ib to be supplied to the light-emitting device at the light-emitting operation time. Accordingly, for example, in a case where display data having luminance of the minimum gray-scale is written, the value of the write current Ia becomes a current value LSB (=LSD+Ioff) where offset current Ioff is added to the current value LSD of the drive current Ib to be supplied to the light-emitting device. Moreover, in a case where luminous gray-scale of display data are m gray-scale and display data having luminance of the maximum gray-scale is written, the value of the write current Ia becomes a current value MSB (=MSD+Ioff=m× LSD+Ioff) where offset current Ioff is added to the current value MSD of the drive current Ib to be supplied to the light-emitting device.

Meanwhile, in the case where the current mirror structure is provided to the aforementioned pixel drive circuit, as illustrated in FIG. 10, the value of the write current Ia' has a fixed current ratio k, which is defined by the current mirror circuit, to the drive current Ib to be supplied to the light-emitting device, and increases in proportion to an increase in the gray-scale. For example, a current value LDB at the time of the minimum gray-scale of the write current Ia and a current value MSB' at the time of the maximum gray-scale have the relation shown in the following equation (7) to the values LSD and MSD of the corresponding drive current Ib, respectively.

$$LDB = LSD \times k,\ MSB' = MSD \times k \quad (7)$$

As a result, as shown in FIG. 10, the current value of the write current Ia in the case of the present embodiment is smaller than that of the write current Ia in the case of the pixel drive circuit having the current mirror structure, and the difference therebetween widens with an increase in the gray-scale.

Moreover, in the case of the present embodiment, since the offset current Ioff is fixed as mentioned above, the increase ratio of the write current Ia to the drive current Ib to be supplied to the light-emitting device increases at the lower gray-scale time, namely, as the drive current Ib becomes smaller, and the increase ratio decreases as the gray-scale moves to the upper state. Here, time required for the writing operation in which the data line is charged up to a predetermined voltage is shortened as the value of the current to flow increases. For this reason, according to the present embodiment, as mentioned above, when the drive current Ib particularly at the low gray-scale time, the write current can be relatively largely increased to shorten the time required for the writing operation and to improve the display response speed, so that the display quality at the low gray-scale time can be improved.

Thus, according to the display device to which the pixel drive circuit of the present embodiment, in contrast to the drive current that is required from the light-emitting operation of the light-emitting device, relatively large write current having a value of current to which a predetermined offset current is added is made to flow to each display pixel. Thereby, even when the small drive current, which corresponds to the relatively lower gray-scale, is supplied to the light-emitting device, the wire capacitance that is present in the data line is charged for a short time to make it possible to shorten the time required for the write operation of gray-scale display data and to perform the light-emitting operation of the light-emitting device satisfactorily with luminance corresponding to the luminous gray-scale of display data. For this reason, the writing operation can be executed with the current value corresponding to a desired luminous gray-scale without being restricted to the selection time when the writing operation of the gray-scale current to each display pixel. Accordingly, the display response speed can be improved. Even if the number of pixels is increased and the selection time is set to be short as in the display panel with small size and high definition, the display data writing operation and the light-emitting operation are satisfactorily executed to make it possible to obtain good display quality. Moreover, the increase in the current relating to the display data writing operation is suppressed to make it possible to control the increase in the power consumption of the display device.

Additionally, in the aforementioned embodiment, the explanation has been given using the circuit structure having three thin-film transistors as the pixel drive circuit. However, the present invention is not limited to this embodiment. The other circuit structure may be provided if the display device has the pixel drive circuit to which the current designation system is applied and the circuit structure has a drive control transistor for controlling the supply of the drive current to the light-emitting device and a write control transistor for controlling the gate voltage of the drive control transistor, and the write current corresponding to display data is charged to a capacitor (for example, parasitic capacitance) added to each control transistor as a voltage component, thereafter the drive control transistor is turned on to supply the drive current according to the charged voltage, thereby emitting the light-emitting device with predetermined luminance.

As explained above, according to the display device of the present invention and the driving method thereof, in the display device having a display panel in which light-emitting devices, which perform self-luminous light emission with predetermined luminance according to a value of current to be supplied, such as organic EL devices, light-emitting diodes and the like are arranged in a matrix form, since it is structured such that the drive current, which is smaller than the write current to the display pixel by a fixed offset current, is supplied to the light-emitting device by the pixel drive circuit added to each display pixel, even if display data having the lowest luminous gray-scale is written, relatively large current is made to flow, thereby making it possible to charge the capacitance components added to the data line and pixel drive circuit and to shorten the time required for a writing operation.

Moreover, in contrast to the drive current for emitting light with luminance corresponding to predetermined display data, the write current to which a fixed offset current is added may be made to flow to each display pixel. For this reason, as compared with the pixel drive circuit using the current mirror system that needs the write current in a predetermined multiple amount of drive current, it is possible to relatively suppress the write current and control power consumption of the display device.

Further, the respective thin-film transistors applied to the pixel drive circuit according to the present embodiment are not particularly limited, and they can be formed of all n-channel type transistors. Accordingly, an n-channel type amorphous silicon TFT can be satisfactorily applied to the thin-film transistor. In this case, the application of the manufacturing technique, which is already established, makes it possible to manufacture the pixel drive circuit having stable operational characteristic at relatively low cost.

Furthermore, the pixel drive circuit according to this embodiment has three transistors to realize driving using the current designation system as mentioned above, and this can be formed with a relatively simple structure. Accordingly, an area required to form the pixel drive circuit can be made relatively small, and the percentage of the light-emitting area of the light-emitting device on the display pixel can be made relatively large, thereby making it possible to improve brightness of the display panel. Moreover, the amount of current to pass per unit area of the light-emitting device can be reduced to obtain desired brightness, so that the life of the light-emitting devices can be increased.

The invention claimed is:

1. A display device that displays image information comprising:

a display panel which comprises:

a plurality of optical elements, each having a pair of electrodes including a first electrode, which is connected to a constant voltage source, and a second electrode, wherein each of the plurality of optical elements performs an optical operation according to current passing between the first and second electrodes thereof;

a plurality of current lines; and a plurality of power lines, each of which is adapted to be charged with a first voltage during a selection time such that the power line does not allow a current to flow therethrough to an optical element, and to be charged with a second voltage during a non-selection time such that the power line allows a current to flow therethrough to an optical element;

wherein the display panel further comprises, for each of the optical elements:

a switch circuit that passes a write current with a predetermined current value through one of the current lines during the selection time and stops passing the write current during the non-selection time, and a current storage circuit which: (i) is connected to one of the power lines and to the second electrode of the optical element, (ii) stores current data according to the current value of the write current passing through the current line during the selection time, and (iii) supplies a drive current having a current value, which is obtained by subtracting a predetermined offset current from the current value of the stored write current, to the optical element during the non-selection time; and wherein each said current storage circuit comprises:

a drive control transistor including a control terminal, and a current path having a first end connected to said one of the power lines and a second end connected to the second electrode of the optical element;

a first capacitor device formed between the control terminal of the drive control transistor and one of the first and second ends of the current path of the drive control transistor;

a write control transistor including a control terminal, and a current path having a first end connected to the control terminal of the drive control transistor and a second end connected to said one of the power lines; and a second capacitor device formed between the control terminal of the write control transistor and one of the first and second ends of the current path of the write control transistor.

2. The display device according to claim 1, wherein the first capacitor device and the second capacitor device are connected to each other in series.

3. The display device according to claim 1, wherein the first capacitor device and the second capacitor device have a same capacitance value.

4. The display device according to claim 1, wherein the second capacitor device has a larger capacitance value than the first capacitor device.

5. The display device according to claim 1, wherein the switch circuit for each of the optical elements includes a current path control transistor in which a first end of a current path is connected to said one of the current lines and a second end of the current path is connected to the current storage circuit for the optical element, wherein the current path is made electrically conductive during the selection time, and the current path is made electrically non-conductive during the non-selection time.

6. The display device according to claim 1, wherein the first capacitor device includes a parasitic capacitance formed between the control terminal and the current path of the drive control transistor, and the second capacitor device includes a parasitic capacitance formed between the control terminal and the current path of the write control transistor.

7. The display device according to claim 1, wherein the drive control transistor and write control transistor comprise amorphous silicon thin-film transistors.

8. The display device according to claim 1, wherein the optical elements comprise light-emitting devices.

9. The display device according to claim 1, wherein the optical elements comprise organic electroluminescence devices.

10. The display device according to claim 1, wherein a plurality of display pixels, each comprising one of the optical elements, the switch circuit for said one of the optical elements, and the current storage circuit for said one of the optical elements, are arrayed in a matrix form on the display panel.

11. The display device according to claim 1, further comprising a data driver that supplies the write current to the current line during the selection time.

12. The display device according to claim 1, wherein the display panel further comprises a plurality of scan lines to which selection signals are applied to select each said switch circuit and current storage circuit connected thereto.

13. The display device according to claim 12, further comprising a scan driver that applies the selection signals to the scan lines.

14. The display device according to claim 12, wherein the switch circuit for each of the optical elements includes a current path control transistor in which a first end of the current path is connected to said one of the current lines and a second end of the current path is connected to the current storage circuit for the optical element, and in which a control terminal of the current path control transistor is connected to one of the scan lines.

15. The display device according to claim 12, wherein in each said current storage circuit, the control terminal of the write control transistor is connected to one of the scan lines.

16. The display device according to claim 12, wherein the offset current is set according to variation in electrical potential of the control terminal of the drive control transistor based on variation in electrical potential of the scan lines during the selection time and non-selection time.

17. The display device according to claim 1, further comprising a power driver that applies the first voltage for supplying the write current to the current line, to the power lines during the selection time, and that applies the second voltage for supplying the drive current to the optical elements to the power lines during the non-selection time.

18. The display device according to claim 17, wherein the first voltage is lower than a potential of the constant voltage source, and the second voltage is higher than the potential of the constant voltage source.

19. The display device according to claim 17, wherein during the non-selection time, the power driver applies voltage, which is one between the control terminal of the drive control transistor and the first end of the current path, to each of the power lines such that the drive current passing through the drive control transistor becomes saturation current.

20. The display device according to claim 1, wherein the offset current is set according to variation in electrical potential of the control terminal of the drive control transistor based on a capacitance ratio between the first capacitor device and the second capacitor device.

21. A method for driving a display device that displays image information wherein the display device comprises a display panel;

wherein the display panel comprises:

a plurality of optical elements, each having a pair of electrodes including a first electrode, which is connected to a constant voltage source, and a second electrode, wherein each of the plurality of optical elements performs an optical operation according to current passing between the first and second electrodes thereof;

a plurality of current lines; and a plurality of power lines, each of which is adapted to be charged with a first voltage during a selection time such that the power line does not allow a current to flow therethrough to an optical element, and to be charged with a second voltage during a non-selection time such that the power line allows a current to flow therethrough to an optical element;

wherein the display panel further comprises, for each of the optical elements:

a switch circuit that passes a write current with a predetermined current value through one of the current lines during the selection time and stops passing the write current during the non-selection time, and a current storage circuit which: (i) is connected to one of the power lines and to the second electrode of the optical element, (ii) stores current data according to the current value of the write current passing through the current line during the selection time, and (iii) supplies a drive current having a current value, which is obtained by subtracting a predetermined offset current from the current value of the stored write current, to the optical element during the non-selection time;

wherein each said current storage circuit comprises:

a drive control transistor including a control terminal, and a current path having a first end connected to said one of the power lines and a second end connected to the second electrode of the optical element;

a first capacitor device formed between the control terminal of the drive control transistor and one of the first and second ends of the current path of the drive control transistor;

a write control transistor including a control terminal, and a current path having a first end connected to the control terminal of the drive control transistor and a second end connected to said one of the power lines; and a second capacitor device formed between the control terminal of the write control transistor and one of the first and second ends of the current path of the write control transistor;

wherein the switch circuit for each of the optical elements comprises a current path control transistor including a current path having a first end connected to said one of the power lines and a second end connected to the current storage circuit for the display element, wherein the current path is made electrically conductive during the selection time, and the current path is made electrically non-conductive during the non-selection time;

wherein the method comprises:

a current storing step for a display element executed in the selection time for the display element, the current storing step including: (i) setting the first voltage across the power line connected to the switch circuit and the current storage circuit for the display element, (ii) activating the write control transistor to supply the write current through the current line to the current storage circuit, and (iii) storing a charge of the write current to the first and second capacitance elements so that the stored charge serves as the current data, and a display step for the display element executed during the non-selection time for the display element, the display step including: (i) setting the second voltage across the power line connected to the switch circuit and the current storage circuit for the display element, (ii) deactivating the write control transistor to stop the supply of the write current to the current storage circuit, (iii) setting the offset current to a value determined by the change of electric potential of the control terminal of the drive control transistor caused in accordance with a difference between respective capacities of the first and second capacitance elements, and (iv) supplying the drive current with the current value, which is obtained by subtracting the value of the offset current from the stored current value of write current.

22. The method according to claim 21, wherein the drive current is supplied to the optical element without passing through the current line in the display step.

23. The method according to claim 21, wherein the write current is supplied without passing through the optical element in the current storing step.

24. The method according to claim 21, wherein the first capacitor device includes a parasitic capacitance formed between the current path and the control terminal of the drive control transistor, and the second capacitor device includes a parasitic capacitance formed between the current path and the control terminal of the write control transistor.

25. The method according to claim 21, wherein the display panel further comprises a plurality of scan lines to which selection signals are applied to select each current storage circuit connected thereto, and wherein in each said switch circuit the control terminal of the current path control transistor is connected to one of the scan lines.

26. The method according to claim 21, wherein voltage to be applied to the power line during the non-selection time is set to voltage, which is one between the control terminal of the drive control transistor set by the voltage and one end of the current path, such that the drive current passing through the drive control transistor during the non-selection time becomes saturation current by voltage between the control terminal of the drive control transistor set by the voltage and one end of the current path.

* * * * *